US007701463B2

(12) United States Patent
Cochran

(10) Patent No.: US 7,701,463 B2
(45) Date of Patent: Apr. 20, 2010

(54) ACCELERATED RENDERING OF IMAGES WITH TRANSPARENT PIXELS USING A SPATIAL INDEX

(75) Inventor: Benjamin D. Cochran, San Rafael, CA (US)

(73) Assignee: Autodesk, Inc., San Rafael, CA (US)

( * ) Notice: Subject to any disclaimer, the term of this patent is extended or adjusted under 35 U.S.C. 154(b) by 754 days.

(21) Appl. No.: 11/125,067

(22) Filed: May 9, 2005

(65) Prior Publication Data

US 2006/0262132 A1 Nov. 23, 2006

(51) Int. Cl.
*G09G 5/02* (2006.01)

(52) U.S. Cl. ..... 345/592; 345/419; 345/421; 345/426; 345/589; 345/598; 345/629; 707/102; 709/232; 382/240

(58) Field of Classification Search ..... 345/589, 345/592, 426, 419, 421, 598, 629; 707/102; 709/232

See application file for complete search history.

(56) References Cited

U.S. PATENT DOCUMENTS

| | | | | |
|---|---|---|---|---|
| 5,841,439 | A | 11/1998 | Pose et al. | |
| 6,081,624 | A | 6/2000 | Krishnaswamy | |
| 6,191,797 | B1 | 2/2001 | Politis | |
| 6,259,826 | B1 | 7/2001 | Pollard et al. | |
| 6,463,180 | B1 | 10/2002 | Krishnaswamy | |
| 6,636,212 | B1 | 10/2003 | Zhu | |
| 6,691,126 | B1 * | 2/2004 | Syeda-Mahmood | 707/102 |
| 7,292,256 | B2 * | 11/2007 | Lawther et al. | 345/629 |
| 2002/0015039 | A1 | 2/2002 | Moore | |
| 2003/0122821 | A1 | 7/2003 | Politis | |
| 2007/0005795 | A1 * | 1/2007 | Gonzalez | 709/232 |

OTHER PUBLICATIONS

Foley, James D., "List-Priority Algorithms" and "Spatial Partitioning", (Book)—Computer Graphics Principles and Practice, 2nd Edition in C, (1997) pp. 664-665 and 672.*

Antonin Guttman, R-trees: a dynamic index structure for spatial searching, ACM SIGMOD Record, v.14 n.2, Jun. 1984 pp. 47-57.*

Sotiris Brakatsoulas, Dieter Pfoser, Yannis Theodoridis, Revisiting R-Tree Construction PRinciples, Lecture Notes In Computer Science; vol. 2435 archive, Proceedings of the 6th East European Conference on Advances in Databases and Information Systems table of contents, pp. 149-162, Year of Publication: 2002.*

Alvy Ray Smith, Alpha and the History of Digital Compositing Technical Memo 7, Aug. 15, 1995.*

Adobe Photoshop Elements 3 in a Snap, Chapter 12, Section 95; pub. Dec. 10, 2004.*

* cited by examiner

*Primary Examiner*—Kimbinh T Nguyen
(74) *Attorney, Agent, or Firm*—Gates & Cooper LLP

(57) ABSTRACT

A method, apparatus, and article of manufacture for accelerated rendering of images with transparent pixels using a spatial index. A determination is made whether anything exists behind an object in an image. If not, then transparent pixels within the object are converted to a background color and rendered as opaque pixels.

12 Claims, 4 Drawing Sheets

ACCELERATED RENDERING OF IMAGES WITH TRANSPARENT PIXELS USING A SPATIAL INDEX

BACKGROUND OF THE INVENTION

1. Field of the Invention

The present invention relates generally to computer-implemented graphics systems, and in particular, to a method, apparatus, and article of manufacture for accelerated rendering of images with transparent pixels using a spatial index.

2. Description of the Related Art

In a computer-implemented graphics program, objects in images may contain transparent pixels. However, rendering transparent pixels can be slow. For example, in the prior art, such rendering is performed on a pixel-by-pixel basis requiring expensive blending or merging calculations of the transparent pixel with pixels behind the transparent pixel.

Thus, there is a need in the art for improved techniques for rendering transparent pixels in images in a computer-implemented graphics system. The present invention satisfies this need.

SUMMARY OF THE INVENTION

To address the requirements described above, the present invention discloses a method, apparatus, and article of manufacture for accelerated rendering of images with transparent pixels using a spatial index. A determination is made whether anything exists behind an object in the image. If not, then transparent pixels within the object are converted to a background color and rendered as opaque pixels.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Overview

The present invention provides an improved method for rendering images with transparent pixels using a spatial index. The present invention converts transparent pixels within an object to a background color and renders the transparent pixels as opaque pixels, if it is known that nothing is behind the object. The present invention uses a spatial index to determine whether anything exists behind the object. If the object is bottom-most, then any transparent pixels in the object are converted to the same color as the background and rendered as opaque pixels.

Hardware and Software Environment

Figure 1:
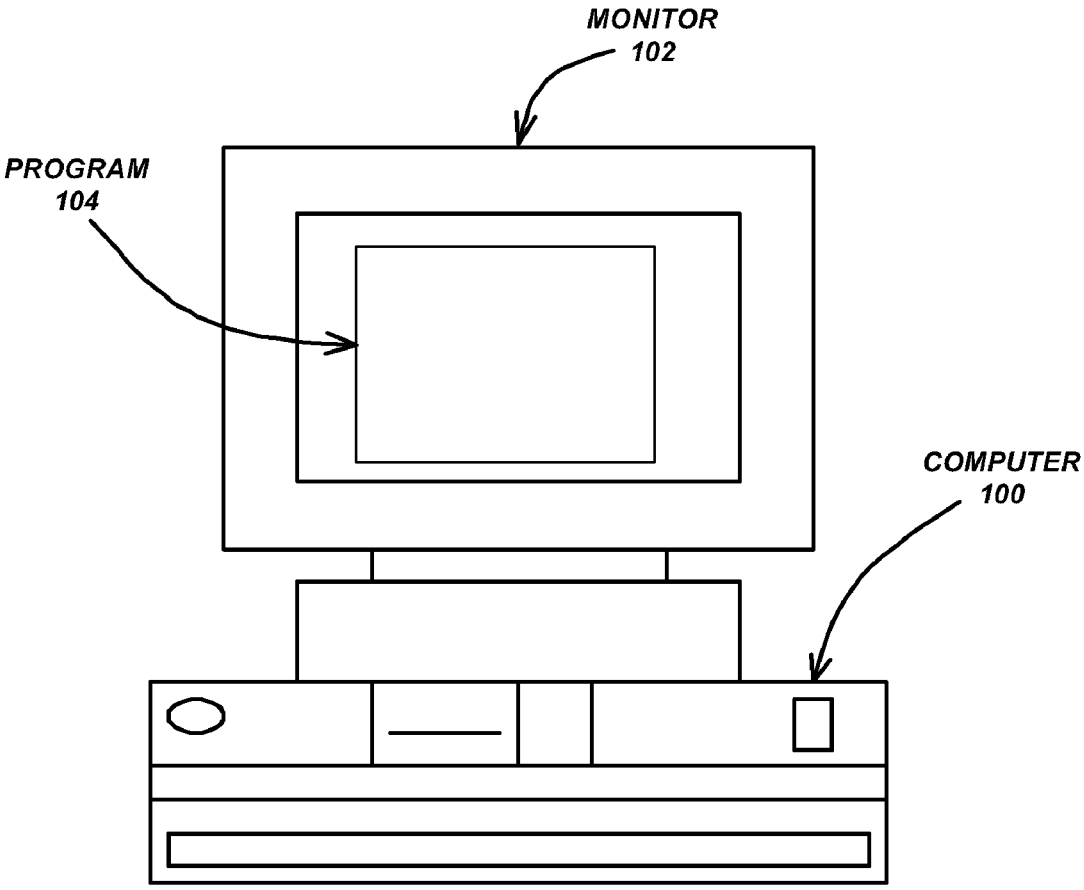
FIG. 1 is an exemplary hardware and software environment used to implement the preferred embodiment of the invention.

FIG. 1 is an exemplary hardware and software environment used to implement the preferred embodiment of the invention. The preferred embodiment of the present invention is typically implemented using a computer 100, which generally includes, inter alia, a monitor 102, and other devices. Those skilled in the art will recognize that any combination of the above components, or any number of different components, peripherals, and other devices, may be used with the computer 100.

The preferred embodiment of the present invention is implemented by a computer-implemented program 104 that is represented by a window displayed on the monitor 102. Generally, the program 104 comprises logic and/or data embodied in or retrievable from a device, media, or carrier, e.g., one or more fixed and/or removable data storage devices connected directly or indirectly to the computer 100, one or more remote devices coupled to the computer 100 via a data communications devices, etc. Moreover, this logic and/or data, when read, executed, and/or interpreted by the computer 100, cause the computer 100 to perform the steps necessary to implement and/or use the present invention.

Thus, the present invention may be implemented as a method, apparatus, or article of manufacture using standard programming and/or engineering techniques to produce software, firmware, hardware, or any combination thereof. The term "article of manufacture," or alternatively, "computer program carrier," as used herein is intended to encompass logic and/or data accessible from any computer-readable device, carrier, or media.

Of course, those skilled in the art will recognize many modifications may be made to this configuration without departing from the scope of the present invention. Specifically, those skilled in the art will recognize that any combination of the above components, or any number of different components, including different computer programs, peripherals, and other devices, may be used to implement the present invention, so long as similar functions are performed thereby.

Image Display

Figure 2:
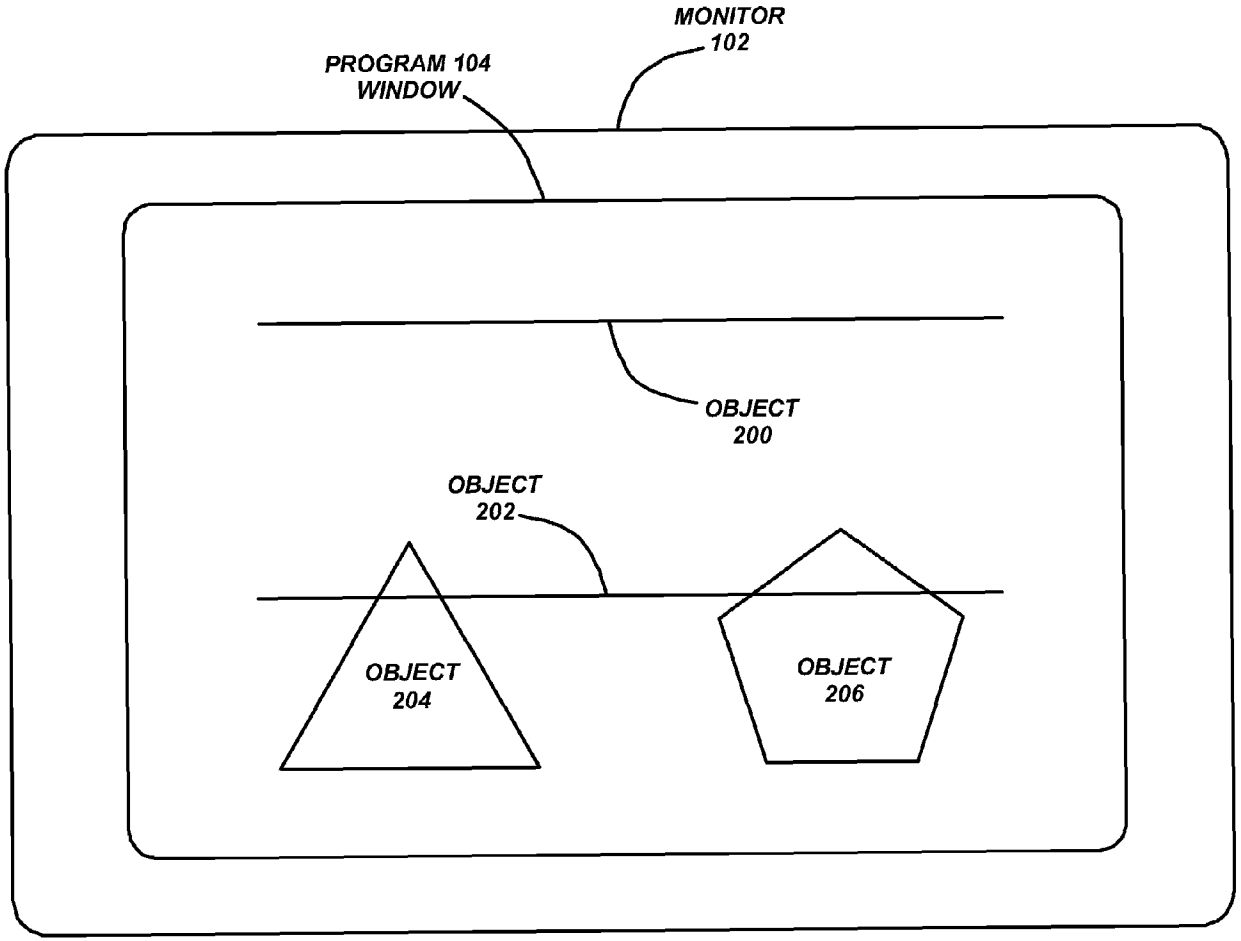
FIG. 2 illustrates an example image display of a plurality of objects within a program window displayed on a monitor according to the preferred embodiment of the present invention.

FIG. 2 illustrates an example display of a plurality of objects 200, 202, 204 and 206 within the program 104 window displayed on the monitor 102 according to the preferred embodiment of the present invention. In this example, object 200 lies near the top of the program 104 window and object 202 lies near the bottom of the program 104 window and in front of objects 204 and 206.

The objects 200-206 may comprise images, bitmaps, vector entities, etc. However, when displayed to any raster device, objects 200-206 each comprise a plurality of pixels, wherein each of the pixels may be characterized by any number of properties, including color and transparency. However, a transparent pixel in the objects 200-206 need not be rendered as a transparent pixel, if it is known that nothing is behind the object 200-206. Instead, it can be converted to a background color of the program 104 window and then rendered as an opaque pixel.

In the preferred embodiment, the objects 200-206 are represented within the program 104 in a hierarchical structure of spatial data comprised of elements, geometries and layers, wherein layers are comprised of geometries, which in turn are comprised of elements, such as lines, triangles, polygons, etc.

The program 104 traverses the hierarchical structure to determine how to render transparent pixels in the objects 200-206, as discussed in more detail below.

Data Structure

Figure 3:
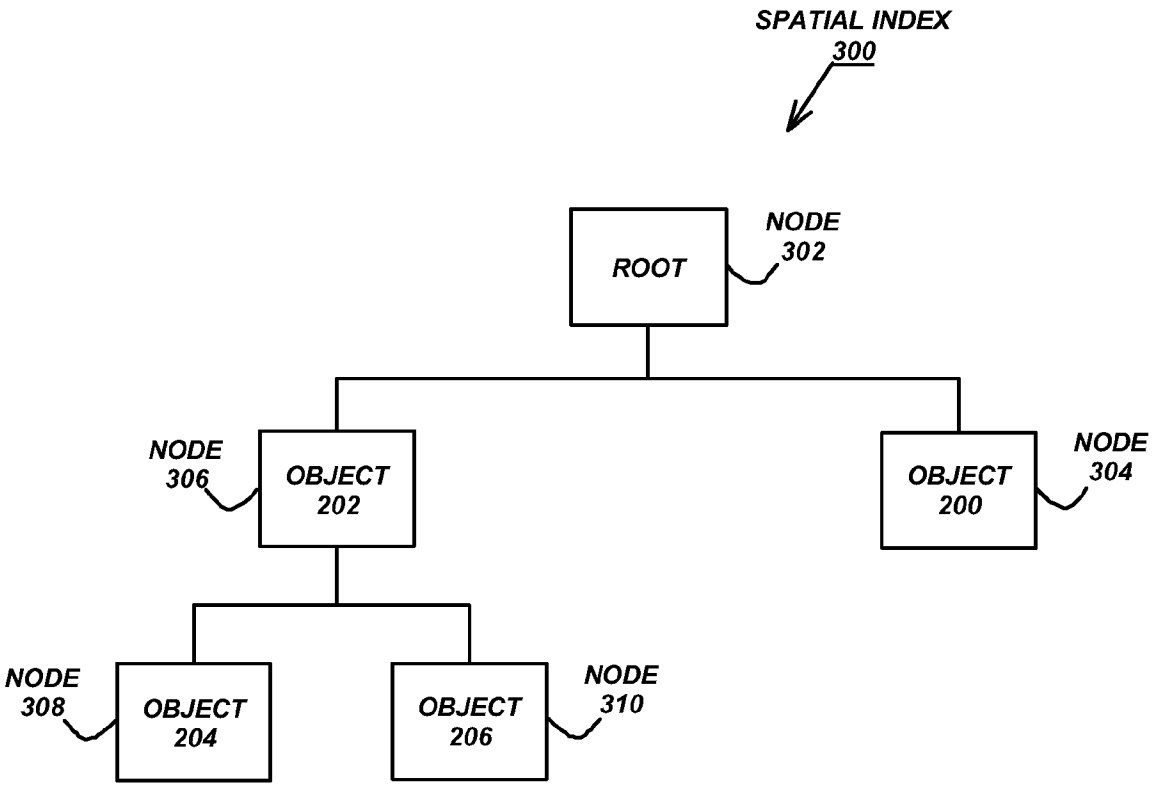
FIG. 3 illustrates the structure of a spatial indexed display list according to the preferred embodiment of the present invention.

FIG. 3 illustrates the structure of a spatial index 300 comprised of one or more nodes 302-310 according to the preferred embodiment of the present invention. In the preferred embodiment, the spatial index 300 is an R-tree maintained by the program 104, wherein the R-tree is an object hierarchy that is formed by aggregating minimum bounding boxes for the objects 200-206, and storing the aggregates in a tree structure. The aggregation is based, in part, on the proximity of the objects 200-206, or their bounding boxes. Thus, the R-tree comprises hierarchically nested, and possibly overlapping, bounding boxes.

In general terms, each node 302-310 of the spatial index 300 represents an object 200-206 to draw (i.e., a line, a triangle, a polygon, etc.) and the location in a frame buffer where the object 200-206 should be drawn. The location of each node 302-310 in the R-tree is based on the location of the object 200-206.

In the example of FIG. 3, the node 302 labeled as "Root" is a root node 302 relative to a subtree comprised of the subordinate nodes 304-310, labeled as objects 200-206, respectively. Thus, the spatial index 300 includes the following information:

A root node 300 that contains the entire display, i.e., objects 200-206.

Nodes 304 and 306 are branches of the subtree, and contain minimum bounding boxes for objects 200 and 202, respectively.

Nodes 308 and 310 are leaf nodes of the subtree, and contain minimum bounding boxes for objects 204 and 206, respectively. Thus, node 306 representing object 202 also contains the minimum bounding boxes for the nodes 308 and 310 representing the objects 204 and 206.

Rendering Transparent Pixels

The program 104 uses the spatial index 300 to determine if anything would be rendered behind a transparent pixel contained within an object 200-206. This is done by the program 104 traversing the branches (e.g., nodes 304 and 306) of the spatial index 300 for a particular area of the image, wherein the leaves (e.g., nodes 304, 308 and 310) of these branches contain objects 200, 204 and 206 in the area. Thus, the spatial index 300 is examined to determine if any objects 200-206 reside in an area.

Using the spatial index 300, objects 200-206 are quickly tested to determine whether they are bottom-most objects 200-206. Usually, this occurs when the objects 200-206 are added to the spatial index 300, but it may also occur when the objects 200-206 are read from the spatial index 300. In the example of FIGS. 2 and 3, it is known from the structure of the spatial index 300 that there is nothing behind objects 200, 204 and 206, but there is something behind object 202, namely objects 204 and 206.

After an object 200, 204 and 206 is known to be bottom-most, the transparent areas of the object 200, 204 and 206 can be changed to the background color and rendered as if they were opaque. Specifically, when drawing opaque pixels, each pixel can be quickly copied into the frame buffer without doing any expensive checking for transparency or merging of pixels. Object 202, on the other hand, is not bottom-most and thus transparent pixels therein require normal rendering.

The present invention provides a significant performance improvement because it can determine whether the transparent pixels in an object 200-206 require expensive blending or merging calculations with pixels behind the transparent pixel. Specifically, using the spatial index 300, the present invention can determine whether transparent pixels in objects 200-206 can be rendered as opaque pixels without examining individual pixels of the objects 200-206. Thus, the present invention can be used to avoid performing expensive blending or merging calculations required when rendering transparent pixels.

Additionally, in the case of objects 200-206 with partially transparent pixels or colors, a blending operation would still be required. This blending operation can be performed as the object 200-206 is read from disk and before it is added to the spatial index 300. Nonetheless, the present invention still would provide performance improvements, as the blending would be a simpler operation and would not be required during a draw operation.

Logic of the Program

Figure 4:
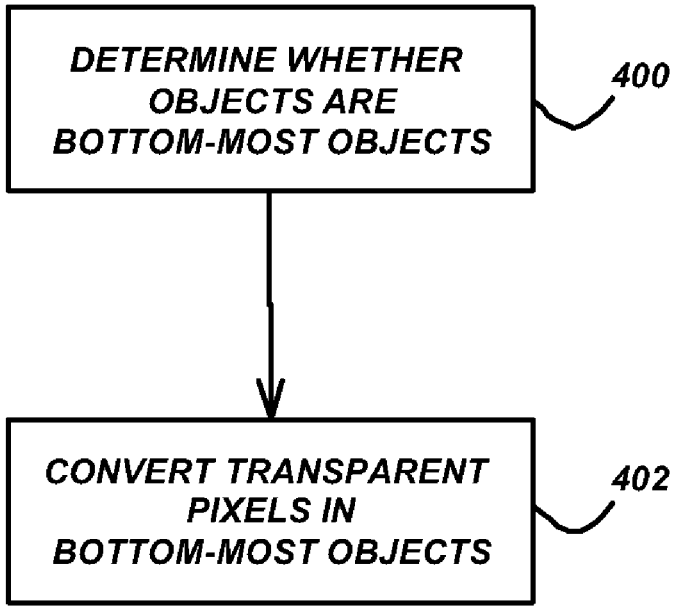
FIG. 4 is a flowchart that illustrates the general logic of the preferred embodiment of the present invention.

FIG. 4 is a flowchart that illustrates the general logic performed by the program 104 for rendering images containing transparent pixels according to the preferred embodiment of the present invention. Those skilled in the art will recognize that this logic is provided for illustrative purposes only and that different logic may be used to accomplish the same results.

Block 400 represents the program 104 determining whether anything exists behind an object in an image. Specifically, this Block represents the program 104 determining whether the object is bottom-most in the image, by using a spatial index to determine whether anything exists behind the object in the image, wherein the spatial index is an R-tree comprised of nodes, and each of the nodes represents a minimum bounding box for one or more objects in the image.

Block 402 represents the program 104 converting transparent pixels within the object to a background color and rendering the transparent pixels as opaque pixels, when nothing exists behind the object in the image.

CONCLUSION

This concludes the description of the preferred embodiment of the invention. The following describes some alternative embodiments for accomplishing the present invention.

For example, any type of computer, such as a mainframe, minicomputer, work station or personal computer, could be used with the present invention. In addition, any program, function, or operating system providing graphical functions could benefit from the present invention. Further, although the preferred embodiment is describes the rendering of images for display, it also applies to the rendering of images for printing. Finally, although specific logic and/or data is described in the preferred embodiment, the present invention also encompasses other logic and/or data. For example, data structures other than an R-tree could be used to implement the present invention, such as a quad-tree or other type of graph.

In summary, the present invention discloses a method, apparatus, and article of manufacture for rendering images containing transparent pixels. A determination is made whether anything exists behind an object in an image. If not, then transparent pixels within the object are converted to a background color and rendered as opaque pixels.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A computer-implemented method for rendering images containing transparent pixels, comprising:

(a) determining, by a computer, whether anything exists behind an object in an image; and (b) converting, by the computer, transparent pixels within the object to a background color and rendering the transparent pixels as opaque pixels for display on a monitor connected to the computer, when nothing exists behind the object in the image.

2. The method of claim 1, wherein the determining step comprises determining whether the object is bottom-most in the image.

3. The method of claim 1, wherein the determining step comprises using a spatial index to determine whether anything exists behind the object in the image.

4. The method of claim 3, wherein the spatial index is an R-tree comprised of nodes, and each of the nodes represents a minimum bounding box for one or more objects in the image.

5. A computer-implemented apparatus for rendering images containing transparent pixels, comprising:

a computer;

means, performed by the computer, for:

(a) determining whether anything exists behind an object in an image; and (b) converting transparent pixels within the object to a background color and rendering the transparent pixels as opaque pixels for display on a monitor connected to the computer, when nothing exists behind the object in the image.

6. The apparatus of claim 5, wherein the means for determining comprises means for determining whether the object is bottom-most in the image.

7. The apparatus of claim 5, wherein the means for determining comprises means for using a spatial index to determine whether anything exists behind the object in the image.

8. The apparatus of claim 7, wherein the spatial index is an R-tree comprised of nodes, and each of the nodes represents a minimum bounding box for one or more objects in the image.

9. An article of manufacture comprising a storage device for storing instructions that, when read and executed by a computer, result in the computer performing a method for rendering images containing transparent pixels, comprising:

(a) determining, by a computer, whether anything exists behind an object in an image;

(b) converting, by the computer, transparent pixels within the object to a background color and rendering the transparent pixels as opaque pixels for display on a monitor connected to the computer, when nothing exists behind the object in the image.

10. The article of claim 9, wherein the determining step comprises determining whether the object is bottom-most in the image.

11. The article of claim 9, wherein the determining step comprises using a spatial index to determine whether anything exists behind the object in the image.

12. The article of claim 11, wherein the spatial index is an R-tree comprised of nodes, and each of the nodes represents a minimum bounding box for one or more objects in the image.

* * * * *